US006253503B1

(12) United States Patent
Flood

(10) Patent No.: US 6,253,503 B1
(45) Date of Patent: Jul. 3, 2001

(54) CASKET ENCLOSURE FOR USE IN MAUSOLEUM CRYPTS

(75) Inventor: Peter M. Flood, Lakeland, FL (US)

(73) Assignee: VKM International, Inc., Lakeland, FL (US)

( * ) Notice: Subject to any disclaimer, the term of this patent is extended or adjusted under 35 U.S.C. 154(b) by 0 days.

(21) Appl. No.: 09/336,872

(22) Filed: Jun. 18, 1999

Related U.S. Application Data

(60) Provisional application No. 60/089,816, filed on Jun. 19, 1998.

(51) Int. Cl.[7] ..... E04H 13/00

(52) U.S. Cl. ..... 52/134; 52/100; 52/140; 27/19; 27/35; 27/DIG. 1

(58) Field of Search ..... 52/134, 100, 140; 27/19, 35, DIG. 1; 220/315, 324, 325, 327, 243

(56) References Cited

U.S. PATENT DOCUMENTS

| | | | | |
|---|---|---|---|---|
| 2,508,319 | | 5/1950 | Westenhaver | 27/35 |
| 2,750,213 | * | 6/1956 | Sale | 220/235 |
| 3,066,379 | | 12/1962 | Meeks | 27/19 |
| 3,103,053 | | 9/1963 | Hollis | 27/35 |
| 3,468,577 | * | 9/1969 | Winston et al. | 220/235 |
| 3,820,205 | | 6/1974 | Shaw | 27/19 |
| 4,154,031 | | 5/1979 | Williamson | 52/100 |
| 4,727,632 | | 3/1988 | Yearsley | 27/35 |
| 4,922,590 | * | 5/1990 | Yearsley | 27/19 |
| 5,115,607 | | 5/1992 | Pirozzoli et al. | 52/134 |
| 5,568,677 | * | 10/1996 | Tobin | 27/17 |

* cited by examiner

*Primary Examiner*—Carl D. Friedman
*Assistant Examiner*—Christy M. Syres
(74) *Attorney, Agent, or Firm*—Carlton Fields PA; Andrew C. Greenberg

(57) ABSTRACT

A method and apparatus for hermetically sealing a casket in an enclosure to be entombed in a mausoleum crypt. The casket enclosure comprises a tray and a flexible cover. An adhesive material is used to affix the cover to the tray. The enclosure includes a check valve to vent any gases that may build up over time.

12 Claims, 2 Drawing Sheets

CASKET ENCLOSURE FOR USE IN MAUSOLEUM CRYPTS

This appln claims benefit of provisional appln 60/089,816 Jun. 19, 1998.

BACKGROUND OF THE INVENTION

This invention relates generally to the arts of mortuary science, and more particularly to a method and an apparatus for the long-term storage of casketed entombments found in mausoleum crypts of all kinds.

It is well known, in mortuary science, to provide a burial vault for enclosing a casket. Such an article, for example, is demonstrated in U.S. Pat. No. 4,154,031. Similar articles and methods for enclosing caskets are found in U.S. Pat. Nos. 3,103,053, 3,820,205, and 5,115,607. Some of the prior art, for example U.S. Pat. No. 5,115,607, discloses a method for enclosing a casket for entombment in an above-ground mausoleum type crypt.

In the prior art, as exemplified by U.S. Pat. No. 5,115,607, it is known to insert a casket into a casket enclosure for storage in a mausoleum type crypt. Here it is taught that the casket is inserted into a box type vault and is sealed at the end with a cap. The sealing mechanism is a chemical that is applied to the juncture of the cap and the box to form a hermetically sealed environment. This process is done while the casket is actually inside the mausoleum crypt, as opposed to being completely sealed in a casket enclosure, prior to placing the casket enclosure and casket inside the crypt. This process creates two main problems. First, the insertion of the casket into the casket enclosure is done while the casket enclosure is actually inside the mausoleum crypt. This creates difficulty in maneuverability. Second, the bonding agent used to seal the cap of the invention to the casket enclosure is capable of dissolving thermoplastic resinous materials. It is, therefore, hazardous, difficult to control, and takes about 24 hours to cure to full strength.

The prior art is also exemplified by U.S. Pat. No. 4,922,590, which discloses a method for long-term storage of entombment caskets in mausoleum crypts. This invention, as distinguished from the previously discussed reference, is comprised of a foldable bottom tray and a wrapping material. The bottom tray, when unfolded, receives the casket. The wrapping is then placed over the casket and attached to the tray to form a hermetically sealed environment. This sealing process is done by using adhesive tape. This adhesive tape, alone, provides a complete hermetic seal of the wrapping material around the casket. The casket must then be lifted and placed inside the mausoleum crypt. This article and method creates three problems. First, the foldable tray is not sturdy enough to be lifted by the sides of the tray. The tray must be rolled on the floor to the opening in the mausoleum crypt and then, when lifted into the crypt, the tray has to be supported from the bottom. Second, after exposure to seasons of hot and cold weather, the adhesive tape used to seal the casket in the casket enclosure begins to loosen, and the seal is broken. Third, because nothing protects the area where the wrapping is sealed to the foldable bottom tray, if extra caution is not taken while inserting the enclosure into the mausoleum crypt, then the walls of the crypt itself could damage the wrapping and adhesive tape, loosening the seal.

It is appreciated in the prior art that a hermetically sealed environment, and a check valve to release building gases released by the decomposition process, is necessary for casket entombment in mausoleum type crypts. A long-term, long-lasting seal is needed to suppress odors and to control insects and other pests. The prior art, however, either makes it difficult to form this seal, or it does not ensure that a long-term, long-lasting seal will exist.

SUMMARY OF THE INVENTION

The present invention provides improvement over the prior art, and it solves problems associated with the prior art. By being able to be assembled outside the mausoleum crypt, the present invention overcomes problems associated with in-crypt assembly. It also overcomes the problems associated with using chemical solvents to create the seal, and also provides structure to reduce the likelihood that the seal between the flexible cover and the adhesive material may loosen and weaken over time, and provides protection to the seal while the casket enclosure is inserted into the mausoleum crypt.

It is an object of the present invention to provide a method and an apparatus for the long-term storage of a casket inside mausoleum crypts. To achieve these and other objects of the invention that will become apparent to those skilled in the art, this invention provides a rigid tray, a flexible cover, and an adhesive material interposed between the cover and the tray. A check valve is included to release gas pressure from within the apparatus.

BRIEF DESCRIPTION OF THE DRAWINGS

A particularly preferred embodiment of the invention of this apparatus will be described in detail below in connection with the drawings in which.

DESCRIPTION OF PREFERRED EMBODIMENTS

Figure 1:
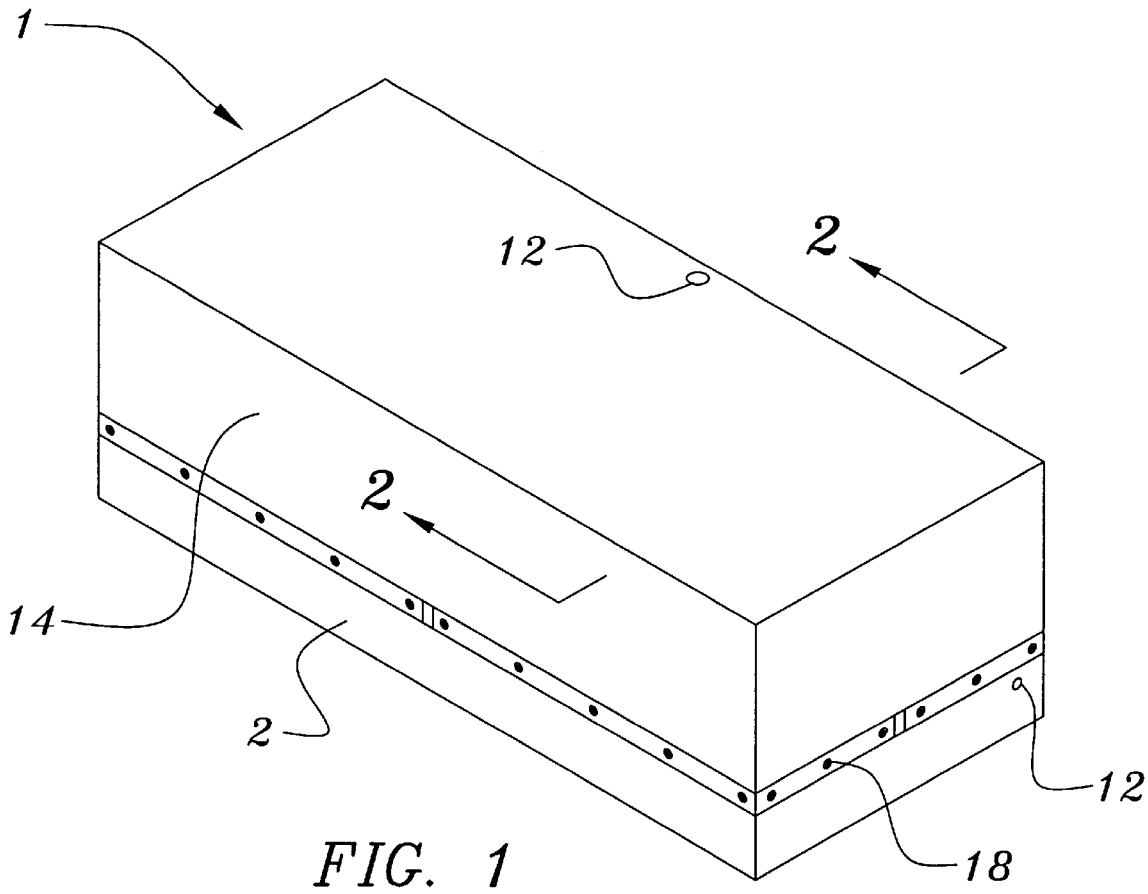
FIG. 1 is a perspective view of the invention.
Figure 2:
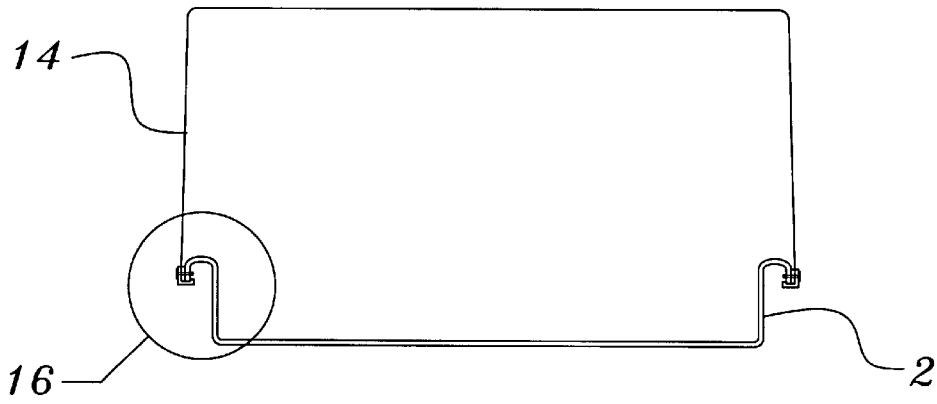
FIG. 2 is cross-sectional view taken along the line 2—2 in FIG. 1.
Figure 3:
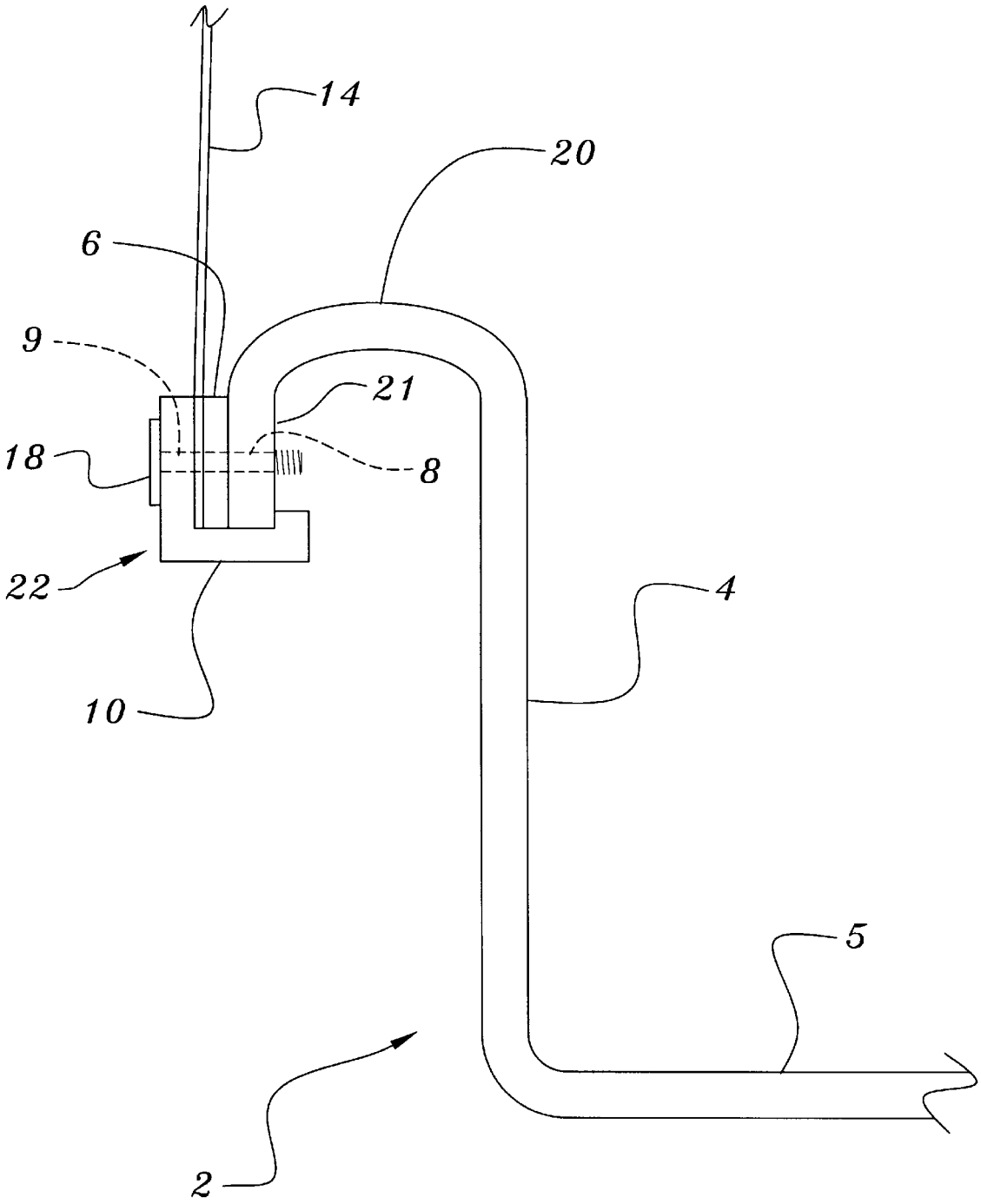
FIG. 3 is a fragmentary sectional view of the area 16 of FIG. 2, at an enlarged scale.

The casket enclosure 1 of the present invention is depicted in FIGS. 1, 2 and 3 in assembled condition. The casket enclosure 1 includes a flexible casket cover 14 and a tray 2, which are attachable to one another to enclose a casket therein.

The tray 2, which suitably may be generally rectangular, is rigid, and can conveniently be formed, as by vacuum forming, from a synthetic resin, which may conveniently be one continuous sheet of thermoplastic resinous material, which is impervious to gases and embalming fluids. Suitably, the tray 2 can be formed with a reinforcing grid pattern in the bottom of the tray. The tray 2 has edges 4 extending generally upwardly from the bottom 5 of the tray 2. The uppermost portion 20 of the edges 4 has a flange portion 21 extending downwardly from the uppermost portion. This edge with flange configuration facilitates the carrying of the casket enclosure by the sides of the tray, without having to support the tray from the bottom. The flange portion 21 preferably has a plurality of apertures 8 therethrough for receiving fasteners therewithin, as described below. Preferably, these apertures are pre-drilled. Conveniently, the uppermost portion 20 and flange 21 can be rolled to form a shape similar to an inverted U, although numerous other configurations are equally suitable. One preferred aspect of the enclosure 1 is the fact that it is able to support a casket while being carried by the sides.

After a casket is placed in the tray 2, a flexible, fluid-tight cover 14 is placed over the casket and flange portions 21.

Preferably, the cover 14 can be pulled approximately one inch (1") down past the bottom of the flange 21. The cover 14 may suitably be fabricated from a coextruded, flexible film of multiple layers of synthetic resin, such as Omniflex C44® by Printpack Inc. Preferably, the cover 14 is transparent, with good sealing and puncture strength. The cover, conveniently, may have a high aroma and odor barrier.

An adhesive material 6 is interposed between the flange portions 21 and the cover 14. This adhesive may conveniently be a pressure sensitive, double-sided foamed synthetic resin tape, which may conveniently be Stik-II® by the October Company. The enclosure 1 has a check valve 12 for releasing gas pressure from within the enclosure. The check valve 12 may be located either on the cover 14 or the tray 2, and can preferably vent when the internal pressure reaches one-tenth (1/10) psi.

Using the adhesive material 6, the cover 14 and the flange portion 21 are engaged. This engagement creates a seal. A clamping device 22 engages the flange portion 21 to urge the cover 14 into sealing engagement with the adhesive material 6. Preferably, the clamping devices 22 comprise a plurality of locking rails 10, each corresponding in length to a flange portion 21 and comprising an elongated, rigid member, which has an aperture 9 therethrough positioned to align with the apertures 8 in the flange portion 21. The clamping devices 22 can conveniently be generally L-shaped and may suitably be formed of metal or a rigid synthetic resin. Preferably, fasteners 18 are receivable through the apertures 8 and 9 on the flange portion 21 and locking rails 10, respectively. The fasteners 18 may be constructed of metal, rigid synthetic resin, or any other suitable material, and may be threaded, serrated, or of other configurations.

While the foregoing describes particularly preferred embodiments of the method and apparatus of this invention, it is to be understood that these embodiments are illustrative only of the principals of this invention and are not to be considered limitative thereof. Because numerous variations and modification of the apparatus and method of this invention, and within the scope of the invention, will readily occur to those skilled in the art, the scope of this invention is to be limited solely by the claims appended hereto.

What is claimed is:

1. A casket enclosure comprising:

a rigid tray having a bottom supporting portion, opposed front and back edges and opposed side edges, said edges extending generally upwardly from said bottom portion and including a flange portion extending downwardly from the uppermost portion of each said edge, said flange portions each having an inner surface and an outer surface;

a flexible cover fabricated of a fluid-tight material and extending over each of said tray edges;

an adhesive material interposed between said edge flange portions and said cover for adhesively engaging both said cover and said flange;

a plurality of clamping devices engaging said flange portions and applying pressure against said cover to urge said cover into sealing engagement with said adhesive material; and a check valve attached to said enclosure for releasing gas pressure from within said enclosure.

2. The casket enclosure of claim 1 wherein said cover is fabricated from a co-extruded, flexible film of multiple layers of synthetic resin.

3. The casket enclosure of claim 1 wherein said adhesive material comprises a pressure sensitive, double-sided adhesive tape.

4. The casket enclosure of claim 3 wherein said tape comprises a strip of foamed synthetic resin.

5. The casket enclosure of claim 1 wherein said flange portions include a plurality of apertures therethrough for receiving fasteners therewithin, and said clamping devices comprise a plurality of locking rails, each corresponding in length to a respective flange portion and comprising an elongated, rigid member having a plurality of apertures therethrough positioned to align with said apertures on said respective flange portion, and a plurality of fasteners receivable through said apertures on said locking rails and said respective flange portions to maintain said locking rails and said respective flange portions in mutual engagement.

6. The casket enclosure of claim 5 wherein each said locking rail comprises an elongated member having a generally L-shaped cross section.

7. A method for enclosing a casket for entombment in a mausoleum type crypt, comprising:

placing a casket on a generally rectangular, rigid tray having a bottom supporting portion and opposed front and back edges and opposed side edges, each said edge extending generally upwardly from said bottom portion and including a flange portion extending downwardly from the uppermost portion of each said edge, said flange portions each having an inner surface and an outer surface;

placing a flexible cover fabricated of a fluid-tight material over said casket and said flange portions of said edges;

engaging said cover and said flange portions with an adhesive material interposed between said flange portions and said cover; and clamping said cover to said flange portions to urge said cover into sealing engagement with said adhesive material.

8. The method of claim 7, wherein said cover is fabricated from a co-extruded, flexible film of multiple layers of synthetic resin.

9. The method of claim 7, wherein said adhesive material comprises a pressure sensitive, double-sided adhesive tape.

10. The method of claim 9, wherein said tape comprises a strip of foamed synthetic resin.

11. The method of claim 7 wherein said clamping step comprises:

applying over each said flange portion and the respectively adjacent portion of said cover a locking rail in the form of an elongated, rigid member, and attaching said locking rails to said respective flange portions to maintain said locking rails and said respective flange portions in clamping engagement with said respectively adjacent cover portions.

12. The method of claim 11 wherein said attaching step comprises insertion of a plurality of fasteners through said locking rails and said flange portions.

* * * * *